US012660887B2

(12) United States Patent
Wang et al.

(10) Patent No.: US 12,660,887 B2
(45) Date of Patent: Jun. 23, 2026

(54) ANTI-BREAKING CLAW ROPE RETRACTOR AND SHOE

(71) Applicant: Quanzhou BXO Technology Co., Ltd., Quanzhou (CN)

(72) Inventors: Liting Wang, Quanzhou (CN); Jianhong Hong, Quanzhou (CN)

(73) Assignee: Quanzhou BXO Technology Co., Ltd., Quanzhou (CN)

( * ) Notice: Subject to any disclaimer, the term of this patent is extended or adjusted under 35 U.S.C. 154(b) by 163 days.

(21) Appl. No.: 18/677,884

(22) Filed: May 30, 2024

(65) Prior Publication Data

US 2025/0017322 A1 Jan. 16, 2025

(30) Foreign Application Priority Data

Jul. 13, 2023 (CN) ..... 202310858287.0

(51) Int. Cl.
*A43C 11/16* (2006.01)

(52) U.S. Cl.
CPC ..... *A43C 11/165* (2013.01)

(58) Field of Classification Search
CPC ..... A43C 11/165; A43C 11/06; A43C 11/08; B65H 75/4494; B65H 75/4471; B65H 75/4421; B65H 75/4455
See application file for complete search history.

(56) References Cited

U.S. PATENT DOCUMENTS

| | | | | |
|---|---|---|---|---|
| 7,367,522 | B2 * | 5/2008 | Chen | A43C 7/00 242/378.1 |
| 10,772,385 | B2 * | 9/2020 | Jiang | A43C 11/165 |
| 10,874,175 | B2 * | 12/2020 | So | A43C 7/08 |
| 11,266,206 | B2 * | 3/2022 | Chen | A43C 11/165 |
| 11,377,322 | B2 * | 7/2022 | Li | A43C 11/165 |
| 11,602,200 | B2 * | 3/2023 | Kim | A43C 11/165 |
| 11,647,813 | B1 * | 5/2023 | Rao | A43C 11/165 24/199 |
| 11,744,329 | B2 * | 9/2023 | Ha | A43C 11/146 24/712.9 |
| 11,771,179 | B2 * | 10/2023 | Kim | A45C 13/30 24/68 R |
| 11,849,810 | B2 * | 12/2023 | Chen | A43C 11/16 |
| 11,896,088 | B1 * | 2/2024 | Peng | A43C 11/165 |
| 11,958,716 | B2 * | 4/2024 | Li | B65H 75/30 |
| 12,048,354 | B2 * | 7/2024 | Hu | A43C 7/08 |
| 12,082,653 | B2 * | 9/2024 | Kim | A44B 99/00 |
| 12,091,281 | B2 * | 9/2024 | Ha | B65H 75/28 |
| 12,104,675 | B1 * | 10/2024 | Xiang | A43C 1/00 |
| 12,108,843 | B2 * | 10/2024 | Chen | A43C 11/165 |

(Continued)

*Primary Examiner* — Jason W San
*Assistant Examiner* — Matthew J Sullivan
(74) *Attorney, Agent, or Firm* — Valet Patent Service Limited; Michael Wiersch

(57) ABSTRACT

The present application proposes an anti-breaking claw rope retractor, comprising a barrel shell, a knob, and a winding shaft inside the barrel shell; further comprising a claw limiting part limiting swinging upward of the claw; the claw limiting part has a limiting position, and the claw has a limited part corresponding to the limiting position. In the process of actual use, the winding shaft can rotate freely in the barrel shell, and under the driving of the knob, the winding shaft can tighten the rope along the rope tightening direction. The present application also proposes a shoe.

18 Claims, 8 Drawing Sheets

(56) References Cited

U.S. PATENT DOCUMENTS

| | | | | |
|---|---|---|---|---|
| 12,137,773 | B2 * | 11/2024 | Chen | B65H 75/4455 |
| 12,150,525 | B1 * | 11/2024 | Kruse | A43C 11/165 |
| 12,396,519 | B1 * | 8/2025 | Xiang | B65H 75/4471 |
| 12,471,679 | B2 * | 11/2025 | Wang | A43C 11/165 |
| 2021/0127795 | A1 * | 5/2021 | Chen | A43C 11/165 |
| 2022/0142304 | A1 * | 5/2022 | Chen | B65H 75/4421 |
| 2023/0248116 | A1 * | 8/2023 | Duller | A43C 11/165 24/68 SK |
| 2024/0180295 | A1 * | 6/2024 | Liu | A43C 11/165 |
| 2024/0382321 | A1 * | 11/2024 | Wood | A43C 11/165 |
| 2024/0417213 | A1 * | 12/2024 | Huang | A43C 11/165 |
| 2024/0423327 | A1 * | 12/2024 | Chen | A43C 11/008 |
| 2025/0024919 | A1 * | 1/2025 | Jiang | B65H 75/4431 |
| 2025/0049177 | A1 * | 2/2025 | Chen | A43C 11/165 |
| 2025/0089850 | A1 * | 3/2025 | Lovett | A43C 11/004 |
| 2025/0176673 | A1 * | 6/2025 | Li | A43C 11/165 |
| 2025/0255382 | A1 * | 8/2025 | Takazakura | A43C 11/165 |
| 2025/0295201 | A1 * | 9/2025 | Giusti | A43B 5/0447 |
| 2025/0295202 | A1 * | 9/2025 | Giusti | A43C 11/165 |

* cited by examiner

ANTI-BREAKING CLAW ROPE RETRACTOR AND SHOE

TECHNICAL FIELD

The present application relates to the field of daily life, and specifically relates to an anti-breaking claw rope retractor and a shoe.

BACKGROUND

A rope such as a rope belt is usually disposed at an opening of an article such as shoes, clothes, backpacks, hats, protective gear, to tighten or loosen. At present, people fix the tightness of the rope by tying knots, the operation is cumbersome and inconvenient, easy to loosen and not simple and beautiful enough.

In order to solve the aforementioned problem, Chinese utility model patent CN201820751299.8 discloses a lacing system based on a rotor and a stator, comprising a rotor and a stator, characterized in that, the stator comprises a stator main member and an extension bracket, the stator main member, the rotor and the extension bracket are matched and connected in sequence, the rotor is provided with a winding groove and a threading hole along a circumferential direction, the rotor or the stator main member is provided with teeth, and the stator main member or the rotor which is matched and connected with the teeth is provided with pawls correspondingly; the stator is provided with a gear structure, and the pawls and the teeth are engaged or separated through the gear structure. The stator main member and the expansion bracket are fixedly connected by a screw or buckle structure. The gear structure is one of a fixed gear and an elastic gear. The fixed gear comprises a gear protrusion and a corresponding retaining ring. The elastic gear comprises an elastic foot and a retaining ring, the elastic foot comprises a root and an elastic body, and at least one limiting groove is provided on an outer side of the elastic body for limiting the retaining ring. The expansion bracket has a module cavity, the module cavity being used to accommodate a function module and a power supply. Teeth are provided on a matching connection surface of the rotor, and pawls are provided correspondingly on a matching connection surface of the stator main member. Teeth are provided on a matching connection surface of the stator main member, and pawls are provided correspondingly on a matching connection surface of the rotor. The lacing system further comprises a cover body, the cover body is matched and connected with the rotor through a buckle, the cover body comprises an accommodating cavity, the accommodating cavity comprises a first inner cavity and a second inner cavity in a stepped distribution, the first inner cavity is used to accommodate the modular cavity portion of the expansion bracket, an inner wall of the first inner cavity is provided with an annular groove near the step along a circumferential direction, and the annular groove is provided with a buckle structure at even intervals along the circumferential direction, for embedded connection with the rotor. A lacing system based on a rotor and a stator, comprising a rotor and a stator, characterized in that, the stator includes only a stator main member, the rotor includes an upper cover, a ratchet wheel and a winding groove fixedly connected in sequence from top to bottom, the stator main member is provided with teeth, and the rotor is provided with paws correspondingly; the stator main member is provided with a elastic stop pin, and the teeth and the pawls are engaged or separated through the elastic stop pin.

The utility model solves the problem of manually tying shoes to a certain extent, in a manner of tightening and loosening the rope through a knob. However, after tightening the rope, the claw is subjected to higher pressure from the latch, and when pulling out the knob to loosening the rope at this time, the claw tooth of the claw may be brought up by the latch due to the greater friction, so that the end of the claw cocks up. At this time, the tension of the rope does not disappear, and generates a bending pressure to the claw, resulting in a destructive situation such as the claw injured or even broken.

In view of this, the inventor of the present case delves into the above problem, so that the present case is made.

SUMMARY

The first object of the present application is to provide an anti-breaking claw rope retractor which provides axial limit protection for the claw and has a reasonable and practical structure.

The second object of the present application is to provide a shoe using the anti-breaking claw rope retractor and having the aforementioned effect.

To achieve the above objects, the present application adopts such a technical solution:

An anti-breaking claw rope retractor, comprising a barrel shell, a knob covering above the barrel shell, and a winding shaft inside the barrel shell; the barrel shell comprising a barrel shell body, the barrel shell body comprising a barrel sidewall and a claw disposed in an area above a lower end of the barrel sidewall; a direction toward the knob being above and an opposite direction being below; further comprising a claw limiting part limiting swinging upward of the claw; the claw limiting part has a limiting position, and the claw has a limited part corresponding to the limiting position; the knob comprises a knob body; the knob body comprises a knob sidewall extending downward; the knob body comprises an annular tooth wall extending downward and corresponding to the claw, the annular tooth wall is located at an inner ring of the knob sidewall, a plurality of knob teeth facing the claw are formed on a side of an inner ring of the annular tooth wall, and an extruding bevel is formed at a lower end of at least one of the annular tooth wall and the knob teeth, the extruding bevel extruding the claw to swing toward the inner ring so that the limited part of the claw is clamped with the claw limiting part.

The barrel shell body has a shaft cavity accommodating the winding shaft, and the claw and the claw limiting part are above the shaft cavity; a main body in which the winding shaft winds at least a rope is in the shaft cavity.

The claw limiting part is connected to the barrel shell body; the claw limiting part is higher than the limited part.

The claw limiting part and the limited part are staggered up and down.

The claw limiting part is above the limited part or at an inner ring of the limited part.

The claw limiting part is located at the inner ring of the limited part, and the claw limiting part and the claw are staggered up and down; the knob body comprises a rotating drive part to drive the winding shaft to rotate, and the rotating drive part is located at the inner ring of the annular tooth wall; the claw limiting part is between a claw tooth and the rotating drive part.

The winding shaft is provided with a rotating driven part that is matched with the rotating drive part.

The rotating drive part comprises a plurality of drive teeth arranged around an axis of the knob body, and the rotating driven part comprises a plurality of driven teeth arranged around the axis of the knob body and below the drive teeth.

Tips of the drive teeth face the driven teeth, and tips of the driven teeth face the drive teeth.

The rotating driven part extends upward into an inner ring of the claw limiting part, and the claw limiting part is between the claw tooth and the rotating driven part.

The knob body comprises a knob post facing the winding shaft, the knob post is located at an inner ring of the drive teeth, and the knob post and the knob body are coaxially disposed.

The rotating driven part is between the claw limiting part and the knob post.

A post protrusion is formed on a lower circumference of the knob post.

The winding shaft has a shaft hole for the knob post to pass through, and the shaft hole and the knob post are coaxially disposed.

The shaft hole is provided with an elastic clamping claw for matching with the post protrusion, and an arm protrusion facing the knob post and matching with the post protrusion is formed on an inner side of the elastic clamping claw.

The elastic clamping claw extends up and down.

A free end of the elastic clamping claw is disposed downward.

The knob post comprises two elastic flaps having a flap gap therebetween, a flap protrusion is formed on a lower outer side of the elastic flap, and each of upper and lower parts of the flap protrusion has a flap bevel.

A lower end of the elastic flap is provided with a flap extension part extending downward, the flap extension part being below the flap protrusion.

The elastic flap is formed with a fine diameter part above the flap protrusion.

The claw comprises an elastic claw arm extending in a direction around the axis of the winding shaft and a claw tooth formed on the elastic claw arm and facing an outer ring.

The elastic claw arm has an arm root and an arm end, and the claw tooth is disposed on an outer ring side of the arm end; the limited part is a limited block disposed on an inner ring side of the elastic claw arm.

The limited block is disposed at a lower part of an inner ring side of the arm end.

An upper part of the elastic claw arm is higher than the limited block.

A space for the elastic claw arm to swing toward the inner ring is above the limited block.

An inner ring side of the limited block is flush with an outer ring side of the claw limiting part; or a plane perpendicular to the axis of the winding shaft is used as a projection plane, and a projection of the inner ring side of the limited block on the projection plane is located at an outer ring of a projection of the outer ring side of the claw limiting part on the projection plane.

A distance between the projection of the inner ring side of the limited block on the projection plane and the projection of the outer ring side of the claw limiting part on the projection plane is smaller than a size of the knob to extrude the claw toward the inner ring.

An upper end of the claw tooth is formed with a tooth homeopathic bevel or chamfer.

A lower edge of the outer ring side of the claw limiting part or an upper edge of the inner ring side of the limited block is provided with a side homeopathic bevel or chamfer.

The elastic claw arm extends gradually from the arm root to the arm end in a direction away from the axis of the winding shaft.

A ring surface on which the elastic claw arm is located is disposed at an inner ring of a ring surface on which the barrel sidewall is located.

A projection of the elastic claw arm in the plane perpendicular to the axis of the winding shaft is disposed at the inner ring of a projection of the barrel sidewall in the plane perpendicular to the axis of the winding shaft.

The barrel shell body has an inner extension part extending toward an inner ring.

The elastic claw arm has an arm root and an arm end, and the inner extension part comprises a bearing part for bearing the claw, and the arm root is connected to the bearing part.

The bearing part comprises a protruding part protruding upward, and the arm root is connected to the protruding part.

Two or more claws and claw limiting parts are distributed around the axis of the winding shaft.

Three claws and claw limiting parts are evenly distributed around the axis of the winding shaft.

The claw limiting part is a limiting beam corresponding to the claw one by one.

The limiting beam is connected between adjacent arm roots.

Each limiting beam forms a whole circle and the inner ring forms a through-opening running up and down.

The knob body comprises a knob post facing the winding shaft, and the knob post passes downward through the through-opening.

The winding shaft is provided with a rotating driven part that passes upward through the through-opening and matches with the rotating drive part.

A gap for the elastic claw arm to swing toward the inner ring is disposed between the limiting beam and the elastic claw arm.

A tooth height from a root to a tip of the claw tooth is smaller than a size of the gap between the limiting beam and the elastic claw arm.

The claw is between the limiting beam and the barrel sidewall, and an elastic swinging space for the elastic claw arm to swing inward and outward is formed between the limiting beam and the barrel sidewall.

A molding gap is between the elastic claw arm and the barrel sidewall, a molding gap is between the elastic claw arm and the claw limiting part, and a molding gap is between the elastic claw arm and the bearing part.

The molding gap runs up and down.

Two or more claws and claw limiting parts are distributed around the axis of the winding shaft; two or more protruding parts are connected to the arm root one by one, and a limiting beam is connected between adjacent protruding parts.

The claw tooth is higher than an upper surface of the bearing part.

Upper parts of both the claw tooth and the elastic claw arm are higher than the inner extension part.

A lower part of the claw is lower than an upper surface of the inner extension part.

A lower part of the claw is lower than an upper surface of the bearing part.

A shaft cavity for accommodating the winding shaft is formed in the barrel shell body below the inner extension part.

Lower surfaces of the elastic claw arm and the limited block are higher than a lower surface of the inner extension part.

A lower surface of at least one of the elastic claw arm and the limited block is provided with a claw protrusion.

An upper surface of the inner extension part is flush with an upper end of the barrel sidewall.

A groove for movement of the limited block is formed at a lower part of the limiting beam.

The claw and the barrel shell body are integrally injection molded.

A molding through-hole for the claw to be demolded and molded is formed between the claw and the barrel sidewall.

The claw limiting part and the barrel shell body are integrally injection molded.

The claw tooth comprises a first clamping surface facing a rope tightening direction, and a first back bevel facing a rope loosening direction; both the first clamping surface and the first back bevel are gradually inclined from root to tip toward the rope tightening direction.

The knob tooth comprises a second clamping surface facing the rope loosening direction, and a second back bevel facing the rope tightening direction; both the second clamping surface and the second back bevel are gradually inclined from root to tip toward the rope loosening direction.

A plane is between the annular tooth wall and the knob sidewall.

The drive tooth comprises a drive surface facing the rope tightening direction and a reverse bevel facing the rope loosening direction, and the drive surface is gradually inclined from root to tip toward the rope tightening direction; the driven tooth comprises a driven surface facing the rope loosening direction and a forward bevel facing the rope tightening direction, and the driven surface is gradually inclined from root to tip toward the rope loosening direction.

A shoe comprising a shoe body and an anti-breaking claw rope retractor assembled to the shoe body.

After adopting the above technical solution, the anti-breaking claw rope retractor of the present application breaks through the construction form of the traditional rope retracting barrel shell. In the process of actual use, the winding shaft is installed in the barrel shell and can rotate freely, and under the driving of the knob, the winding shaft can tighten the rope along the rope tightening direction. When the rope needs to be tightened, the knob is moved toward the direction of the barrel shell body, and the extruding bevel at the lower end of the knob tooth will extrude the claw toward the direction of the inner ring, so that the limited part of the claw is clamped with the claw limiting part. The limiting position of the claw limiting part is matched with the limited part of the claw to limit the claw along the axis of the winding shaft, to prevent the claw from swinging upward, and the knob tooth won't bring up the claw, so that the claw won't bend upward, regardless of whether there is a tension of the rope or not, so as to ensure that the claw will not be injured or even broken. Compared with the prior art, the anti-breaking claw rope retractor of the present application has the advantages of axial limit protection for the claw, a reasonable and practical structure and so on.

The shoe of the present application breaks through the construction form of the traditional laces retracting of the shoes. In the process of actual use, the anti-breaking claw rope retractor can be installed on the shoe, and specifically can be sewed or glued on the shoe body through a connection base. The winding shaft can rotate freely in the barrel shell, and under the driving of the knob, the winding shaft can tighten the rope along the rope tightening direction. When the rope needs to be tightened, the knob is moved toward the direction of the barrel shell body, and the extruding bevel at the lower end of the knob tooth will extrude the claw toward the direction of the inner ring, so that the limited part of the claw is clamped with the claw limiting part. The limiting position of the claw limiting part is matched with the limited part of the claw to limit the claw along the axis of the winding shaft, to prevent the claw from swinging upward, and the knob tooth won't bring up the claw, so that the claw won't bend upward, regardless of whether there is a tension of the rope or not, to ensure that the claw will not be injured or even broken. Compared with the prior art, the shoe of the present application has the advantages of axial limit protection for the claw, a reasonable and practical structure and so on.

1—barrel shell body 11—barrel sidewall 12—claw 121—limited part 122—elastic claw arm 1221—arm root 1222—arm end 123—claw tooth 1231—tooth homeopathic bevel 1232—first clamping surface 1233—first back bevel 124—claw protrusion 13—claw limiting part 131—limiting position 132—groove 14—side homeopathic bevel 15—inner extension part 151—bearing part 1511—protruding part 16—through-opening 17—molding gap

2—knob body 21—knob sidewall 22—annular tooth wall 23—knob tooth 231—extruding bevel 232—second clamping surface 233—second back bevel 24—rotating drive part 241—drive tooth 2411—drive surface 2412—reverse bevel 25—knob post 251—elastic flap 252—flap gap 2521—flap protrusion 25211—flap bevel 253—flap extension part 254—fine diameter part 255—annular protrusion 256—clamp ring

3—winding shaft 31—rotating driven part 311—driven tooth 3111—driven surface 3112—forward bevel 32—shaft hole 321—protrusion ring 33—elastic clamping claw 331—arm protrusion 4—connection base 5—shoe body.

DETAILED DESCRIPTION

To further explain the technical solution of the present application, the detailed elaborations by means of specific embodiments are as follows.

Figure 1:
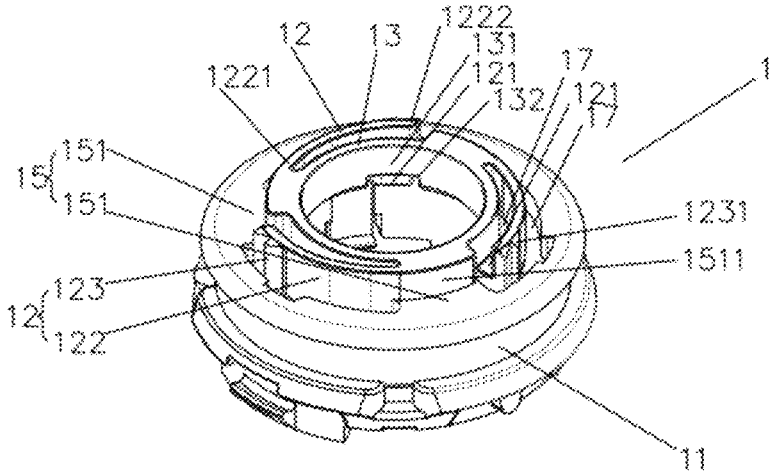
FIG. 1 is a schematic diagram of a stereochemical structure of the barrel shell.
Figure 2:
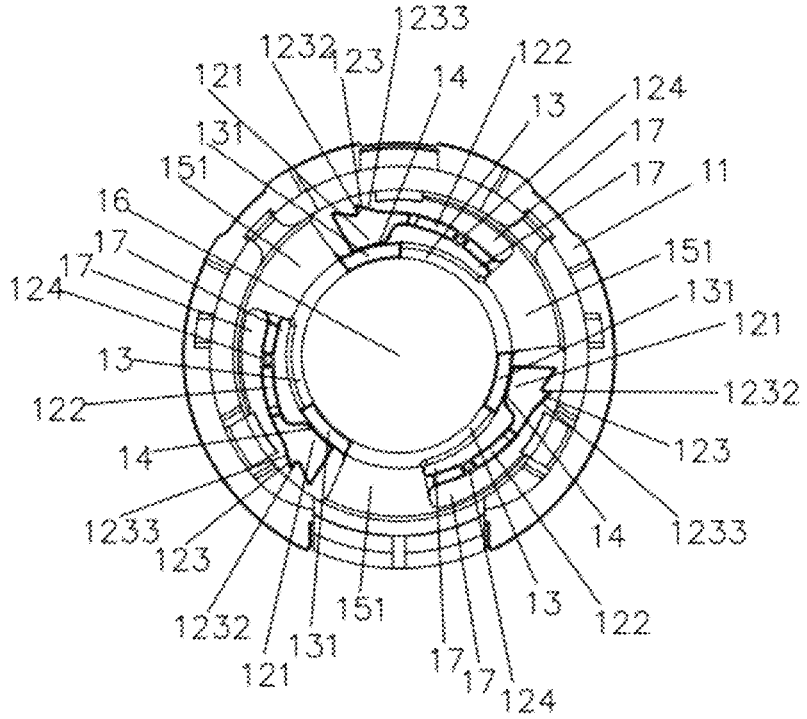
FIG. 2 is a schematic diagram of a bottom view structure of the barrel shell.
Figure 3:
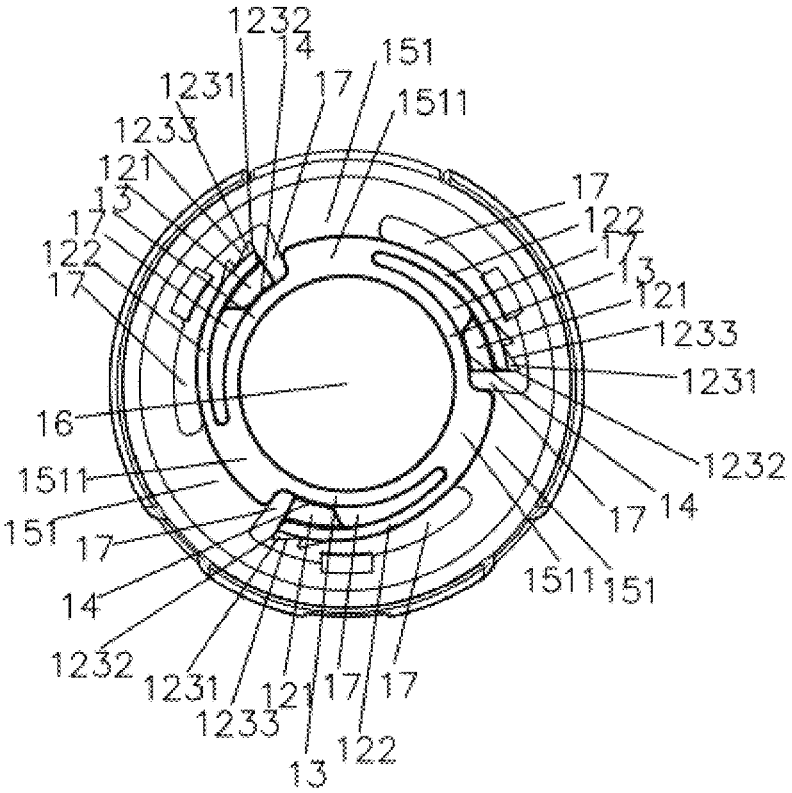
FIG. 3 is a schematic diagram of a top view structure of the barrel shell.
Figure 4:
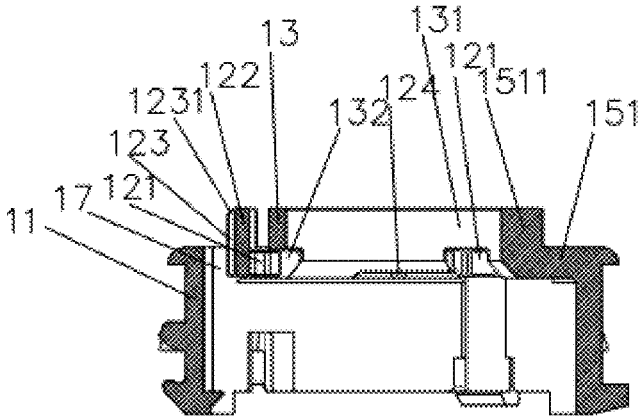
FIG. 4 is a schematic diagram of a sectional view structure of the barrel shell.
Figure 5:
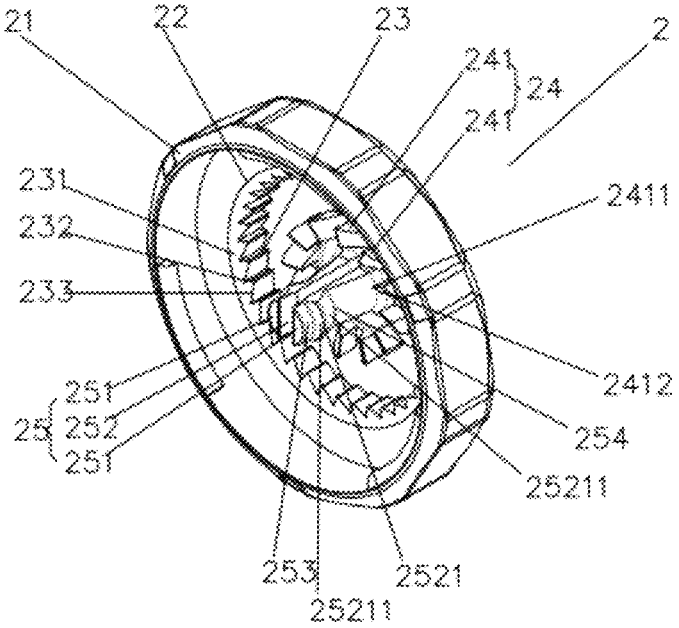
FIG. 5 is a schematic diagram of a stereochemical structure of the knob.
Figure 6:
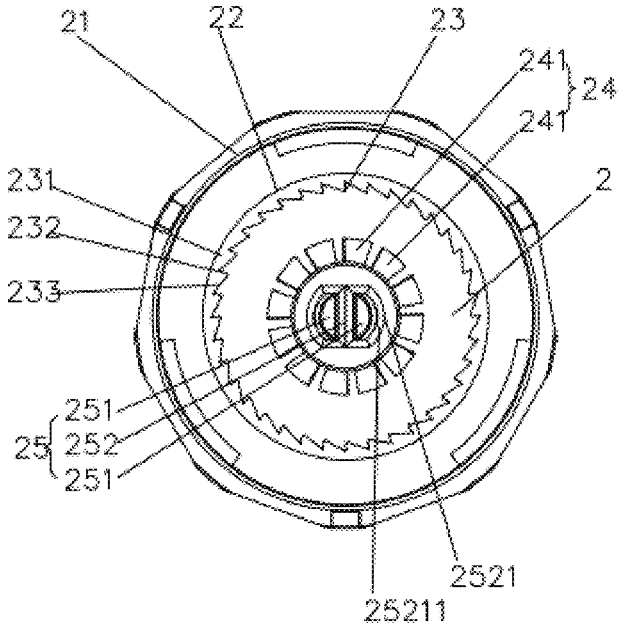
FIG. 6 is a schematic diagram of a bottom view structure of the knob.
Figure 7:
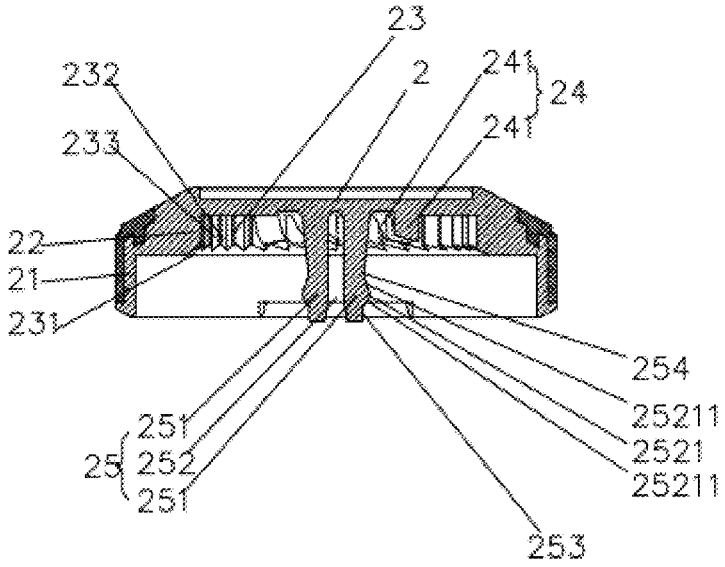
FIG. 7 is a schematic diagram of a sectional view structure of the knob.
Figure 8:
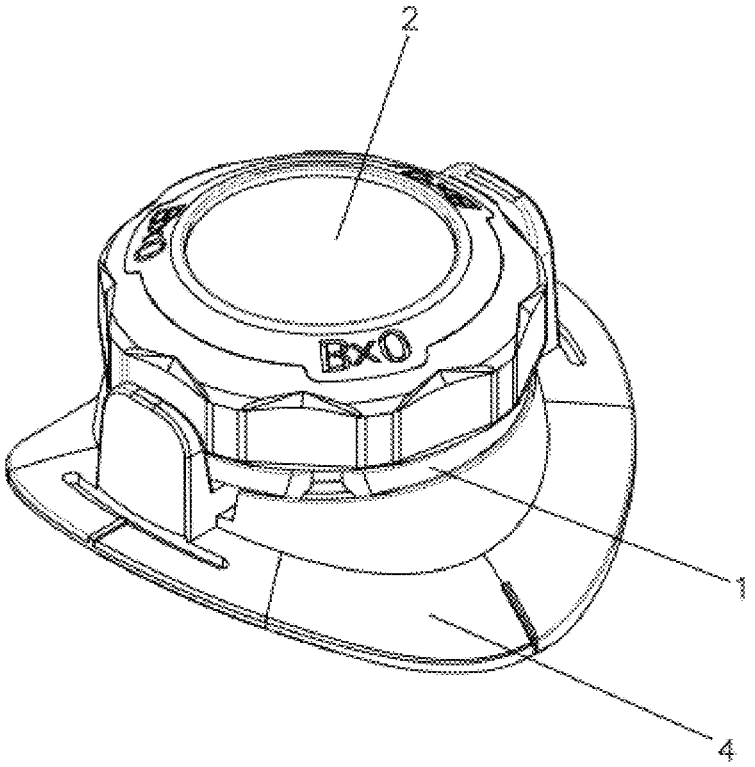
FIG. 8 is a schematic diagram of a stereochemical structure of the anti-breaking claw rope retractor.
Figure 9:
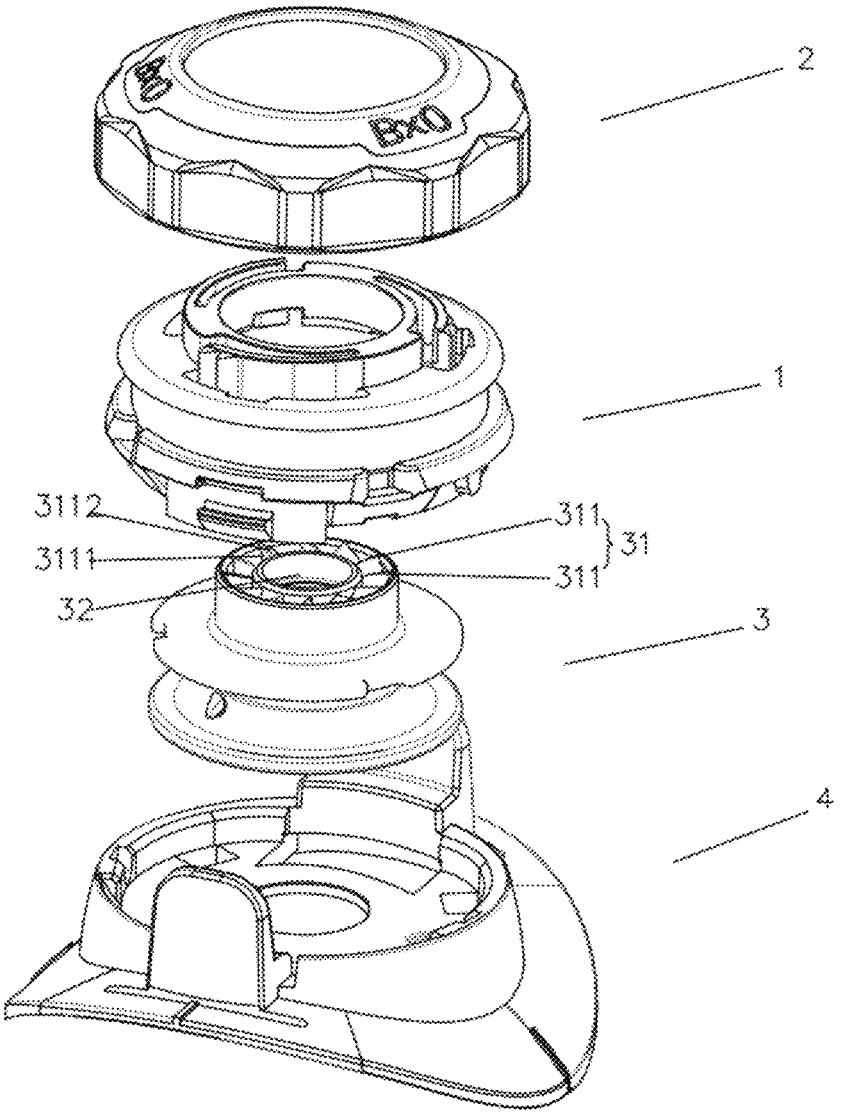
FIG. 9 is a schematic diagram of a decomposition structure of the anti-breaking claw rope retractor.
Figure 10:
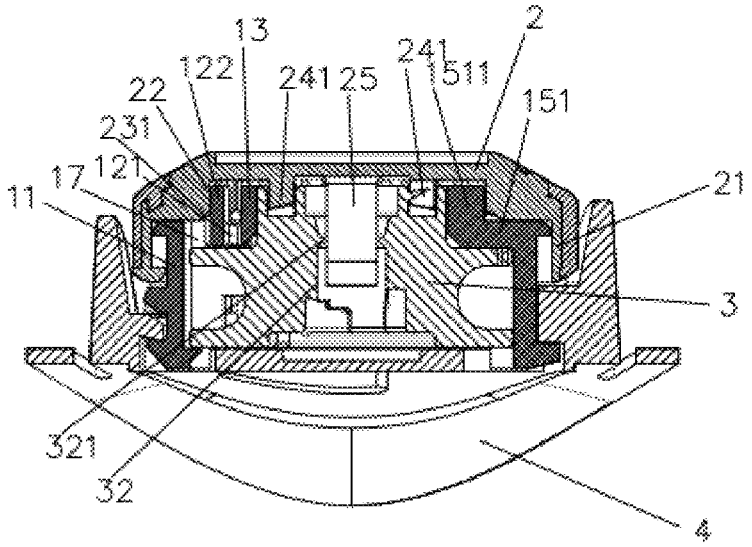
FIG. 10 is a schematic diagram of a sectional view structure of the anti-breaking claw rope retractor.
Figure 11:
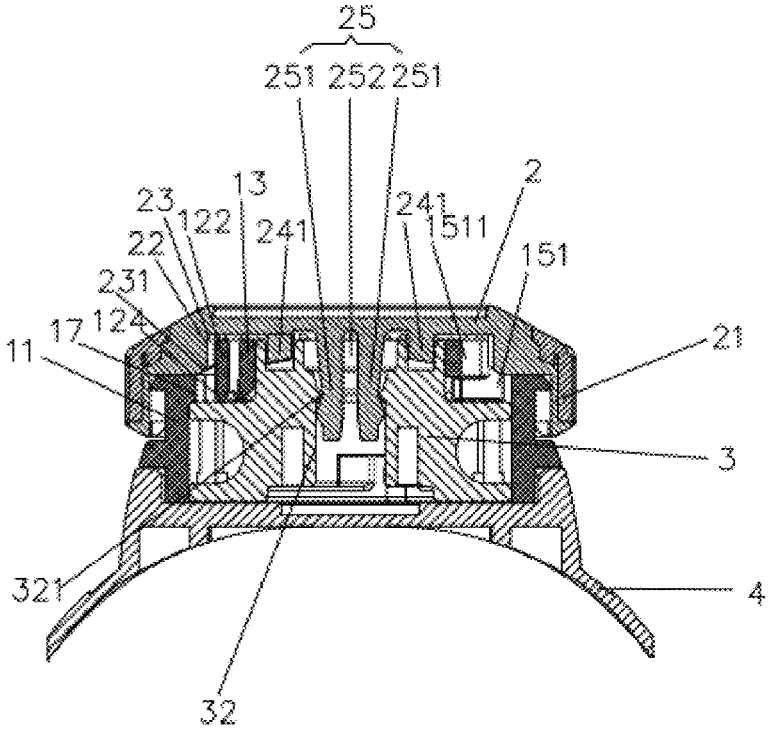
FIG. 11 is a schematic diagram of a sectional view structure at another angle of the anti-breaking claw rope retractor.
Figure 12:
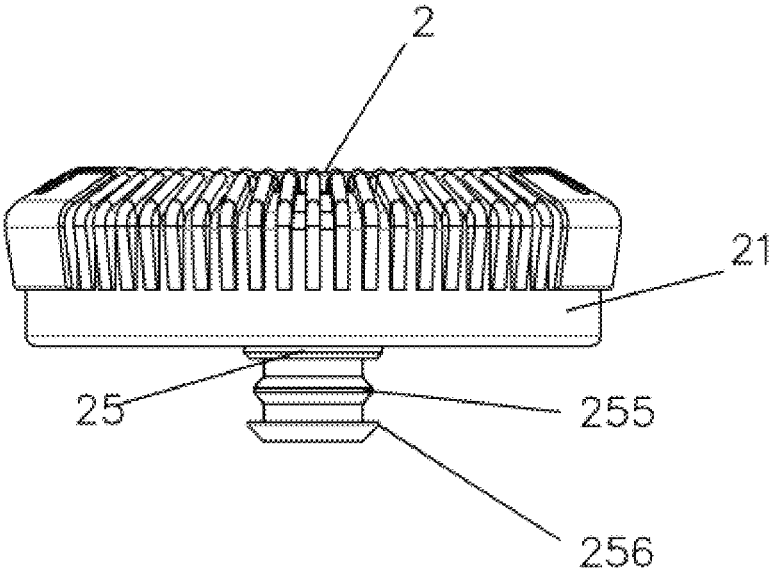
FIG. 12 is a schematic diagram of a structure of another embodiment of the knob.
Figure 13:
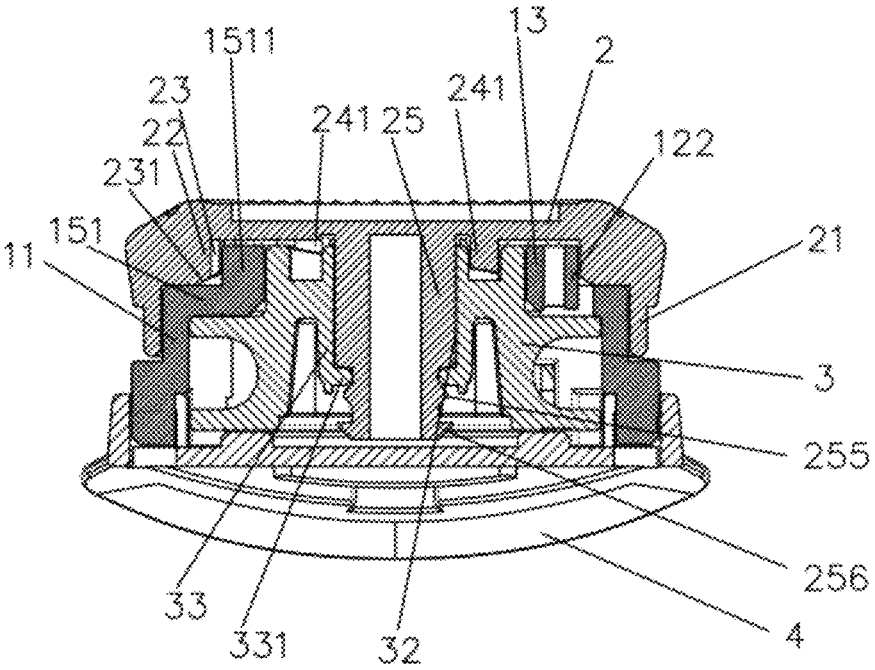
FIG. 13 is a schematic diagram of a sectional view structure of another embodiment of the anti-breaking claw rope retractor.
Figure 14:
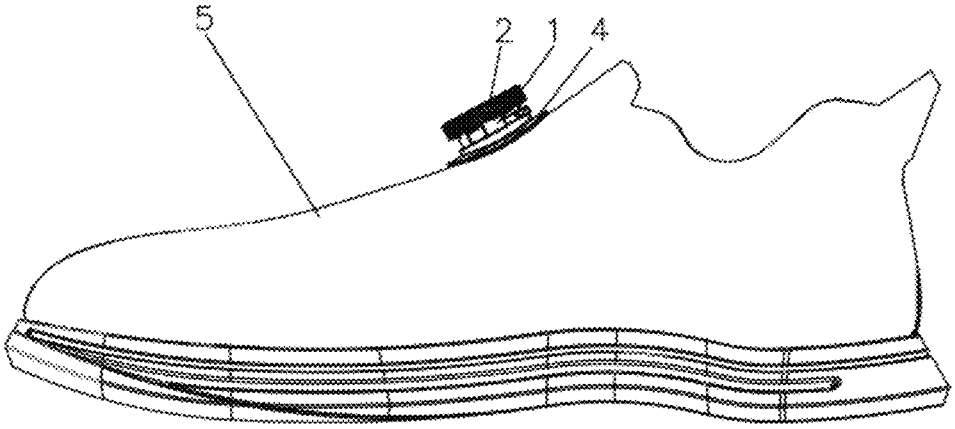
FIG. 14 is a schematic diagram of a structure of the anti-breaking claw rope retractor applied to an article such as a shoe.

An anti-breaking claw rope retractor of the present application, as shown in FIGS. 1-14, comprises a barrel shell, a knob covering above the barrel shell, and a winding shaft 3 inside the barrel shell; the barrel shell comprises a barrel shell body 1, the barrel shell body 1 comprises a barrel sidewall 11 and a claw 12 disposed in an area above a lower end of the barrel sidewall 11; a direction toward the knob is above and an opposite direction is below; the anti-breaking claw rope retractor further comprises a claw limiting part 13 limiting swinging upward of the claw 12; the claw limiting part 13 has a limiting position 131, and the claw 12 has a limited part 121 corresponding to the limiting position 131; the knob comprises a knob body 2; the knob body 2 comprises a knob sidewall 21 extending downward; the knob body 2 comprises an annular tooth wall 22 extending downward and corresponding to the claw 12, the annular tooth wall 22 is disposed at an inner ring of the knob sidewall 21, a plurality of knob teeth 23 facing the claw 12 are formed on a side of an inner ring of the annular tooth wall 22, and an extruding bevel 231 is formed at a lower end of at least one of the annular tooth wall 22 and the knob teeth 23, the extruding bevel 231 extruding the claw 12 to swing toward the inner ring so that the limited part 121 of the claw 12 is clamped with the claw limiting part 13. In the process of actual use, the winding shaft 3 is installed in the barrel shell and can rotate freely, and under the driving of the knob, the winding shaft 3 can tighten the rope along the rope tightening direction. When the rope needs to be tightened, the knob is moved toward the direction of the barrel shell body 1, and the extruding bevel 231 at the lower end of the knob tooth 23 will extrude the claw 12 toward the direction of the inner ring, so that the limited part 121 of the claw 12 is clamped with the claw limiting part 13. The limiting position 131 of the claw limiting part 13 is matched with the limited part 121 of the claw 12 to limit the claw 12 along the axis of the winding shaft 3, so as to prevent the claw 12 from swinging upward, and the knob tooth 23 won't bring up the claw 12, so that the claw 12 won't bend upward, regardless of whether there is a tension of the rope or not, so as to ensure that the claw 12 will not be injured or even broken. The specific structure may be as follows: the limiting position 131 of the claw limiting part 13 prevents the knob teeth 23 from bringing up the end of the claw 12 where the claw teeth 123 are located by blocking above the limited part 121 of the claw 12. The extruding bevel 231 is specifically a bevel that is gradually inclined to the outer ring from top to bottom, and the extruding bevel 231 tends to extrude the claw teeth 123 toward the inner ring when the knob is moved downward. Further, the lower end of the extruding bevel 231 exceeds the lower end of the knob teeth 23 and forms a whole circle of bevel, and the extruding bevel 231 in the form of a whole circle of bevel may drive the claw teeth 123 toward the inner ring at any angle.

In another embodiment, the barrel shell body 1 has a shaft cavity accommodating the winding shaft 3, and the claw 12 and the claw limiting part 13 are above the shaft cavity; a main body in which the winding shaft 3 winds at least a rope is in the shaft cavity. The claw 12 can directly correspond to the above knob, the matching is high-efficiency, and the below winding shaft 3 plays a certain support role for the claw 12 and the claw limiting part 13. Moreover, the shaft cavity winding the rope is below and no interference will occur, which ensures the strength of the components and the stability of matching.

In another embodiment, the claw limiting part 13 is connected to the barrel shell body 1; the claw limiting part 13 is higher than the limited part 121. This structure enables the barrel shell body 1 to bear the claw limiting part 13 and to be suspended above the winding shaft 3, and ensures the strength of the claw limiting part 13 and no interference from the rotation of the winding shaft 3. The specific structure may be as follows: the claw limiting part 13 and the barrel shell body 1 may be an integral structure, and molded by integral injection molding. Moreover, the claw limiting part 13 is higher than the limited part 121. This structure facilitates the claw limiting part 13 to at least partially block above the limited part 121 for limiting.

In another embodiment, the claw limiting part 13 and the limited part 121 are staggered up and down. This structure facilitates direct demolding of the claw limiting part 13 and the limited part 121 in the upper and lower directions, which is conducive to integral injection molding. The specific structure may be as follows: when the knob is moved toward the claw 12, the claw 12 may be driven to drive the limited part 121 to move laterally to the underside of the claw limiting part 13, thereby realizing that the claw limiting part 13 limits above the limited part 121.

In another embodiment, the claw limiting part 13 is above the limited part 121. This structure facilitates the claw limiting part 13 to block directly above the limited part 121 for limiting.

In another embodiment, the claw limiting part 13 is disposed at an inner ring of the limited part 121. This structure allows the claw limiting part 13 not to interfere with the matching between the knob teeth 23 and the claw teeth 123, and facilitates direct demolding of the claw limiting part 13 and the limited part 121 in the upper and lower directions, which is conducive to integral injection molding. Moreover, when the knob is moved toward the claw 12, the claw 12 may be driven to drive the limited part 121 to move to the underside of the claw limiting part 13 toward the inner ring, thereby realizing that the claw limiting part 13 limits above the limited part 121.

In another embodiment, the claw limiting part 13 is disposed at the inner ring of the limited part 121, and the claw limiting part 13 and the claw 12 are staggered up and down; the knob body 2 comprises a rotating drive part 24 to drive the winding shaft 3 to rotate, and the rotating drive part 24 is disposed at the inner ring of the annular tooth wall 22; the claw limiting part 13 is between the claw teeth 123 and the rotating drive part 24. This structure facilitates direct demolding of the claw limiting part 13 and the limited part 121 in the upper and lower directions, which is conducive to integral injection molding. Moreover, when the knob is moved toward the claw 12, the claw 12 can be driven to drive the limited part 121 to move to the underside of the claw limiting part 13 toward the inner ring, thereby realizing that the claw limiting part 13 limits above the limited part 121. When the knob is moved downward, the rotating drive part 24 contacts the winding shaft 3, and can rotationally drive the winding shaft 3 in the rope tightening direction. The rotating drive part 24 at the inner ring of the annular tooth wall 22 is more favorable to match with the rotating driven part 31 of the winding shaft 3 at the inner ring of the claw 12 in an upward and downward correspondence. The claw limiting part 13 is located between the claw teeth 123 and the rotating drive part 24, which facilitates the claw teeth 123 to match directly with the claw limiting part 13. Further, the winding shaft 3 is provided with a rotating driven part 31 that is matched with the rotating drive part 24, and the knob relies on the matching between the rotating drive part 24 and the rotating driven part 31 to drive the winding shaft 3 and prevent reversal.

In another embodiment, the rotating drive part 24 comprises a plurality of drive teeth 241 arranged around an axis of the knob body 2, and the rotating driven part 31 comprises a plurality of driven teeth 311 arranged around the axis of the knob body 2 and below the drive teeth 241. When the knob is moved downward, the drive teeth 241 engage with the passive teeth on the winding shaft 3, can rotationally drive the winding shaft 3 in a rope tightening direction, and prevent the winding shaft from rotating in a rope loosening direction by the matching between the driving part and the driven part. When the knob is lifted upward, the drive teeth 241 are disengaged from the passive teeth of the winding shaft 3, and the winding shaft 3 can be reversed to loosen the rope. The specific structure may be as follows: a plurality of drive teeth 241 are uniformly arranged around the axis of the knob body 2, so that the drive teeth 241 can be rotated to any angle to engage with the passive teeth of the winding shaft 3. Further, the tips of the drive teeth 241 are provided toward the winding shaft 3. When the knob is moved downward, the drive teeth 241 can directly and efficiently engage with the passive teeth. Still further, the drive teeth 241 include a drive surface 2411 toward the rope tightening direction and a reverse bevel 2412 toward the rope loosening direction, the drive surface 2411 being gradually inclined from root to tip toward the rope tightening direction. The drive teeth 241 is homeopathically stuck into the passive teeth of the winding shaft 3 at any angle in all directions by the reverse bevel 2412, and drive and resist the passive teeth by the drive surface 2411, to prevent reversal. Further, tips of the drive teeth 241 face the driven teeth 311, and tips of the driven teeth 311 face the drive teeth 241. This structure can make the drive teeth 241 and the driven teeth 311 more conducive to direct upper and lower engagement. Further, the drive tooth 241 comprises the drive surface 2411 toward the rope tightening direction and the reverse bevel 2412 toward the rope loosening direction, and the drive surface 2411 is gradually inclined from root to tip toward the rope tightening direction; the driven tooth 311 comprises a driven surface 3111 toward the rope loosening direction and a forward bevel 3112 toward the rope tightening direction, and the driven surface 3111 is gradually inclined from root to tip toward the rope loosening direction. The drive teeth 241 is homeopathically stuck into the passive teeth of the winding shaft 3 at any angle in all directions by the reverse bevel 2412 and the forward bevel 3112, and drive and resist the passive teeth by the drive surface 2411 and the driven surface 3111, to prevent reversal.

In another embodiment, the rotating driven part 31 extends upward into the inner ring of the claw limiting part 13, and the claw limiting part 13 is between the claw teeth 123 and the rotating driven part 31. The rotating driven part 31 matches upward with the rotating drive part 24, meanwhile the rotating driven part 31 is mutually limited in the inner ring of the claw limiting part 13, and facilitates direct matching between the claw limiting part 13 and the claw teeth 123. Moreover, the rotating driven part 31 can be kept always in the inner ring of the claw limiting part 13, which facilitates direct matching with the rotating drive part 24 up and down without passing through the inner ring of the claw limiting part 13 during every action, to ensure stability and reliability.

In another embodiment, the knob body 2 comprises a knob post 25 facing the winding shaft 3, the knob post 25 is disposed at an inner ring of the drive teeth 241, and the knob post 25 and the knob body 2 are coaxially disposed. Further, a post protrusion is formed on a lower circumference of the knob post 25. The knob post 25 may specifically be a cylinder having a post hole, the post protrusion may specifically be an annular protrusion 255 formed in the lower peripheral wall of the knob post 25, a shaft hole 32 matching with the knob post 25 is formed in the middle of the winding shaft 3, an elastic clamping claw 33 matching with the annular protrusion 255 is formed at the shaft hole 32, the knob post 25 matches with the elastic clamping claw 33 through the annular protrusion 255, and the elastic clamping claw 33 utilizes the elastic deformation to be stuck at the lower or upper end of the annular protrusion 255 for limiting, so as to realize the switching action of pulling out or pressing in the knob. Further, the upper portion of the annular protrusion 255 is formed with an upper bevel and the lower portion is formed with a lower bevel, so that the annular protrusion 255 realizes a soft relative movement with respect to the elastic clamping claw 33. Still further, the upper bevel is longer than the lower bevel, so that the annular protrusion 255 needs to be pulled out to a larger size to cross the elastic clamping claw 33. When the edge of the knob is pried, the knob is tilted and relies on the hooking claw of the knob sidewall 21 to hook at the annular step at the upper end of the outer periphery of the barrel shell body 1, and the knob post 25 will not be pulled out from the elastic clamping claw 33, so that the rope will not be mistakenly loosened, and the operating feel is ensured to a certain degree. Alternatively, by disposing a claw ring 256 that can be stuck at the lower end of the elastic clamping claw 33 at the lower end of the knob post 25, the knob post 25 is prevented from completely disengaging from the elastic clamping claw 33. Further, the knob post 25 and the knob body 2 are coaxially disposed, to ensure stable and smooth rotation of the knob without eccentricity. Still further, the winding shaft 3 has a shaft hole 32 for the knob post 25 to pass through, and the shaft hole 22 and the knob post 25 are coaxially disposed. This ensures stable and smooth rotation of the winding shaft 3 without eccentricity. Further, the shaft hole 32 is provided with an elastic clamping claw 33 for matching with the post protrusion, and an arm protrusion 331 facing the knob post 25 and matching with the post protrusion is formed on an inner side of the elastic clamping claw 33. The arm protrusion 331 can form an upward and downward clamping effect with the annular protrusion 255.

In another embodiment, the elastic clamping claw 33 extends up and down. During the up and down movement of the knob post 25 relative to the winding shaft 3, the elastic claw arm 122 homeopathically generates elastic deformation. Further, the free end of the elastic clamping claw 33 is disposed downward. Based on facilitating the homeopathic elastic deformation of the elastic claw arm 122, a certain downward supporting effect on the knob post 25 can also be generated.

In another embodiment, the rotating drive part 24 is between the claw limiting part 13 and the knob post 25. The structure is compact and stable.

In another embodiment, the knob post 25 comprises two elastic flaps 251 having a flap gap 252 therebetween, a flap protrusion 2521 is formed on a lower outer side of the elastic flap 251, and each of upper and lower parts of the flap protrusion 2521 has a flap bevel 25211. The flap gap 252 can be used for the inward elastic deformation of the two elastic flaps 251. Further, a flap projection 2521 is formed on the lower outer side of the elastic flap 251, each of upper and lower parts of the flap protrusion 2521 has a flap bevel 25211, the shaft hole 32 matching with the knob post 25 is formed in the middle of the winding shaft 3, a protrusion ring 321 matching with the flap projection 2521 is formed in the shaft hole 32, and the flap bevel 25211 allows the flap projection 2521 to realize a soft relative movement with respect to the protrusion ring 321. Still further, a lower end of the elastic flap 251 is provided with a flap extension part 253 extending downward, the flap extension part 253 being below the flap protrusion 2521. When the knob post 25 is pulled out upward and is above the protrusion ring 321, the flap extension part 253 is still matching with the inner ring of the protrusion ring 321, so that the flap projection 2521 is always aligned with the protrusion ring 321. When the flap projection 2521 is moved downward, it can smoothly and efficiently slide over the protrusion ring 321, and the rotation of the knob is more stable and smoother. The specific structure may be as follows: an annular step is formed at the upper end of the outer periphery of the barrel shell body 1, and a hook claw that can be hooked under the annular step is formed on the inner side of the lower end of the knob sidewall 21. Specifically, three hook claws may be evenly disposed.

In another embodiment, the elastic flap 251 is formed with a fine diameter part 254 above the flap protrusion 2521. When the flap projection 2521 is below the protrusion ring 321, the fine diameter part 254 corresponds to the protrusion ring 321, ensuring that the knob post 25 and the winding shaft 3 rotate relative to each other without scratching.

In another embodiment, the claw 12 comprises an elastic claw arm 122 extending in a direction around the axis of the winding shaft 3 and claw teeth 123 formed on the elastic claw arm 122 and facing an outer ring. The claw teeth 123 can directly match with the knob teeth 23 facing the inner ring, and can cause the elastic claw arm 122 to form an action of swinging toward the inner ring or the outer ring, which can be compatible with the form of the claw limiting part 13 limiting above the claw 12. Further, the elastic claw arm 122 may be an outward arched curved arc, and the knob teeth 23 can abut against and strengthen the outside of the elastic claw arm 122 of outward arched curved arc, to ensure the compressive strength of the elastic claw arm 122. Further, the elastic claw arm 122 has an arm root 1221 and an arm end 1222, and the claw teeth 123 are disposed on an outer ring side of the arm end 1222; the limited part 121 is a limited block disposed on an inner ring side of the elastic claw arm 122. The claw teeth 123 are disposed on the side of the outer ring of the arm end 1222 to ensure efficient elastic deformation by fully utilizing the entire length of the elastic claw arm 122 and to enable the elastic claw arm 122 to form an action of swinging toward the inner ring or the outer ring. The limited part 121 in the form of the limited block is disposed on the side of inner ring of the elastic claw arm 122, to facilitate the elastic claw arm 122 which swings inward and outward to drive the limited block to swing inward and outward, so that the limited block and the claw limiting part 13 are completely staggered up and down, which is conducive to the integral injection molding and demolding and ensures that the limited block after swinging toward the inner ring can be below the claw limiting part 13 and be effectively blocked.

In another embodiment, the limited block is disposed at a lower part of an inner ring side of the arm end 1222. This structure facilitates the height of the limited block to be lower than the limiting position 131, but also allows the claw 12 to have a sufficiently high part above the limited block, so that the claw 12 and the claw limiting part 13 are at roughly the same height as a whole and have inner and outer counterparts, which is conducive to the inner and outer disposition and inner and outer ring limit of both, and high efficiency use of space, and facilitates corresponding matching between the claw 12 and the annular tooth wall 22.

In another embodiment, an upper part of the elastic claw arm 122 is higher than the limited block. This structure allows the claw 12 to have a sufficiently high part above the limited block, so that the claw 12 and the claw limiting part 13 are at roughly the same height as a whole and have inner and outer counterparts, which is conducive to the inner and outer disposition and inner and outer ring limit of both, and high efficiency use of space, and facilitates corresponding matching between the claw 12 and the annular tooth wall 22.

In another embodiment, a space for the elastic claw arm 122 to swing toward the inner ring is above the limited block. This space is available for the elastic claw arm 122 to swing toward the inner ring and allows the limited block to be blocked and limited while it is below the limiting position 131.

In another embodiment, an inner ring side of the limited block is flush with an outer ring side of the claw limiting part 13. This structure ensures that the elastic claw 12 which swings inward drives the limited block to be blocked and limited directly below the claw limiting part 13, based on ensuring that the limited block and the claw limiting part 13 are staggered up and down to facilitate the up and down demolding for integral injection molding. Minimizing the distance between the limited block and the claw limiting member 13 can ensure that the limited block is efficiently hidden under the claw limiting member 13, so that it can be limited.

In another embodiment, a plane perpendicular to the axis of the winding shaft 3 is used as a projection plane, and a projection of the inner ring side of the limited block on the projection plane is disposed at an outer ring of a projection of the outer ring side of the claw limiting part 13 on the projection plane. This structure minimizes the distance between the limited block and the claw limiting part 13 as much as possible and can ensure that the elastic claw 12 which swings inward drives the limited block to be blocked and limited directly below the claw limiting part 13, based on ensuring that the limited block and the claw limiting part 13 are staggered up and down to facilitate the up and down demolding for integral injection molding.

In another embodiment, a distance between the projection of the inner ring side of the limited block on the projection plane and the projection of the outer ring side of the claw limiting part 13 on the projection plane is smaller than a size of the knob to extrude the claw 12 toward the inner ring. This structure can ensure that the claw 12 after being extruded by the inner ring of the knob can cause the limited block to be below the claw limiting part 13 to be blocked and limited, based on ensuring that the limited block and the claw limiting part 13 are staggered up and down to facilitate the up and down demolding for integral injection molding.

In another embodiment, an upper end of the claw tooth 123 is formed with a tooth homeopathic bevel 1231 or chamfer. When the knob is moved toward the barrel shell body 1, this tooth homeopathic bevel 1231 or chamfer is available for the knob teeth 23 or the annular tooth wall 22 to extrude the claw teeth 123 homeopathically toward the inner ring, so that the arm end 1222 of the claw 12 swings toward the inner ring, and drives the limited block to be moved under the claw limiting part 13 to blocked and limited.

In another embodiment, a lower edge of the outer ring side of the claw limiting part 13 or an upper edge of the inner ring side of the limited block is provided with a side homeopathic bevel 14 or chamfer. This side homeopathic bevel 14 or chamfer is available for the limited block to enter the underside of the claw limiting part 13 homeopathically and smoothly, when the limited block is moved toward the claw limiting part 13.

In another embodiment, the elastic claw arm 122 extends gradually from the arm root 1221 to the arm end 1222 in a direction away from the axis of the winding shaft 3. This structure allows the elastic claw arm 122 to have a margin for swinging toward the inner ring, and when the knob is moved toward the barrel shell body 1, the elastic claw arm 122 will be extruded, so that the arm end 1222 swings toward the inner ring. The elastic claw arm 122 generates elastic deformation and provides a certain amount of pre-load, so that the claw teeth 123 match with the knob teeth 23. When the claw teeth 123 match with the knob teeth 23, the elastic claw arm 122 is disposed at or close to the arc, ensuring the strength of the elastic claw arm 122 and the strength of the claw teeth 123 in blocking the knob teeth 23.

In another embodiment, a ring surface on which the elastic claw arm 122 is located is disposed at an inner ring of a ring surface on which the barrel sidewall 11 is located. This structure ensures that the ring surface on which the elastic claw arm 122 is located and the ring surface on which the barrel sidewall 11 is located are staggered inward and outward, facilitating the up and down demolding process.

In another embodiment, a projection of the elastic claw arm 122 in the plane perpendicular to the axis of the winding shaft 3 is disposed at the inner ring of a projection of the barrel sidewall 11 in the plane perpendicular to the axis of the winding shaft 3. This structure ensures that the ring surface on which the elastic claw arm 122 is located and the ring surface on which the barrel sidewall 11 is located are completely staggered inward and outward, facilitating the up and down demolding process.

In another embodiment, the barrel shell body 1 has an inner extension part 15 extending toward the inner ring. The inner extension part 15 can block above the winding shaft 3 to limit the winding shaft 3, and can be used to bear at least one of the claw 12 and the claw limiting part 13. When both the claw 12 and the claw limiting part 13 are injection molded integrally with the barrel shell body 1, the inner extension part 15 can simultaneously bear and reinforce the claw 12 and the claw limiting part 13. Further, the elastic claw arm 122 has an arm root 1221 and an arm end 1222, and the inner extension part 15 comprises a bearing part 151 for bearing the claw 12, and the arm root 1221 is connected to the bearing part 151. The elastic claw arm 122 being beared by the bearing part 151 ensures strength.

In another embodiment, the bearing part 151 comprises a protruding part 1511 that protrudes upward, and the arm root 1221 is connected to the protruding part 1511. The protruding part 1511 can bear and reinforce the elastic claw arm 122 protruding upward, facilitating the claw 12 to extend into the inner ring of the annular tooth wall 22 and making the claw teeth 123 match with the knob teeth 23. The specific structure may be as follows: the upper surface of the protruding part 1511 is flush with the upper surface of the claw 12, and the height of the protruding part 1511 and the claw 12 protruding from the upper end of the barrel sidewall 11 is 1-4 mm.

In another embodiment, two or more claws 12 and claw limiting parts 13 are distributed around the axis of the winding shaft 3. The two or more claws 12 may make the knob teeth 123 match with the knob teeth 23 in all directions, so that the force is uniform; at the same time, the two or more claw limiting parts 13 may correspond to the claws 12 one by one, to limit the corresponding limited part 121 in all directions. The specific structure may be as follows: three or four claws 12 and claw limiting parts 13 are evenly distributed around the axis of the winding shaft 3, ensuring that the claws 12 and the knob teeth 23 are subjected to uniform and omni-directional force.

In another embodiment, the claw limiting part 13 is a limiting beam corresponding to the claw 12 one by one. When the arm end 1222 is extruded to drive the limited part 121 to move toward the inner ring, the limiting beam can directly block above the limited part 121 of the claw 12 in one-to-one correspondence for limiting. The specific structure may be that the limiting beam is connected between adjacent arm roots 1221. Further, each limiting beam forms a whole circle and the inner ring forms a through-opening 16 running up and down. That is, each limiting beam is disposed around the through-opening 16 and forms a whole circle, which ensures the strength of the limiting beam and allows the winding shaft 3 to contact the knob.

In another embodiment, each limiting beam forms a whole circle and the inner ring forms the through-opening 16 running up and down. That is, each limiting beam is disposed around the through-opening 16 and forms a whole circle, which ensures the strength of the limiting beam and allows the winding shaft 3 to contact the knob. Further, the knob body 2 comprises the knob post 25 facing the winding shaft 3, and the knob post 25 passes downward through the through-opening 16 to match with the winding shaft 3.

In another embodiment, the winding shaft 3 is provided with a rotating driven part 31 that passes upward through the through-opening 16 and matches with the rotating drive part 24. The rotating driven part 31 matches upward with the rotating drive part 24, meanwhile the rotating driven part 31 is mutually limited in the inner ring of the claw limiting part 13, and facilitates direct matching between the claw limiting part 13 and the claw teeth 123. Moreover, the rotating driven part 31 can be kept always in the inner ring of the claw limiting part 13, which facilitates direct matching with the rotating drive part 24 up and down without passing through the inner ring of the claw limiting part 13 during every action, to ensure stability and reliability.

In another embodiment, a gap for the elastic claw arm 122 to swing toward the inner ring is disposed between the limiting beam and the elastic claw arm 122. This space allows the elastic claw arm 122 to swing toward the inner ring and allows the limited part 121 to be blocked and limited while it is below the limiting position 131. Further, a tooth height from a root to a tip of the claw tooth 123 is smaller than a size of the gap between the limiting beam and the elastic claw arm 122. When the knob is moved in the direction of the barrel shell body 1, this structure ensures that the knob drives the tip of the claw tooth 123 inward, to drive the limited part 121 toward the inner ring and allow the limited part 121 to be blocked and limited while it is below the limiting position 131.

In another embodiment, the claw 12 is between the limiting beam and the barrel sidewall 11, and an elastic swinging space for the elastic claw arm 122 to swing inward and outward is formed between the limiting beam and the barrel sidewall 11. The claw 12 may be elastically deformed in the elastic swinging space for swinging inward and outward, and especially during homeopathic sliding and engaging of the knob teeth 23 and the claw teeth 123, the elastic swinging space may be available for the claw 12 to elastically swing inward and outward.

In another embodiment, a molding gap 17 is between the elastic claw arm 122 and the barrel sidewall 11, between the elastic claw arm 122 and the claw limiting part 13, and between the elastic claw arm 122 and the bearing part 151. That is, only the root of the elastic claw arm 122 is connected to the barrel shell body 1. During processing, the elastic claw arm 122, the barrel shell body 1 and the claw limiting part 13 can be integrally injection molded by using the molding gap 17, which facilitates demolding and allows the elastic claw arm 122 to independently swing toward the inner and outer rings. Further, the molding gap 17 runs up and down. This structure facilitates direct up and down demolding for molding the elastic claw arm 122, the claw limiting part 13, and the barrel shell body 1.

In another embodiment, two or more claws 12 and claw limiting parts 13 are distributed around the axis of the winding shaft 3; two or more protruding parts 1511 are connected to the arm root 1221 one by one, and a limiting beam is connected between adjacent protruding parts 1511. The two or more claws 12 may make the knob teeth 123 match with the knob teeth 23 in all directions, so that the force is uniform; at the same time, the two or more claw limiting parts 13 may correspond to the claws 12 one by one, to limit the corresponding limited part 121 in all directions. The specific structure may be as follows: three or four claws 12 and claw limiting parts 13 are evenly distributed around the axis of the winding shaft 3, ensuring that the claws 12 and the knob teeth 23 are subjected to uniform and omni-directional force. Moreover, the limiting beam is connected between adjacent protruding parts 1511, so that the limiting beam and the protruding parts 1511 support each other, which can effectively ensure strength.

In another embodiment, the claw tooth 123 is higher than an upper surface of the bearing part 151. That is, the claw tooth 123 protrudes upward from the upper surface of the bearing part 151 to facilitate extending into the inside of the knob sidewall 21 and matching with the knob tooth 23. Further, upper parts of both the claw tooth 123 and the elastic claw arm 122 are higher than the inner extension part 15. The elastic claw arm 122 can support the inner ring of the claw tooth 123 as much as possible, so that the mutual force of the claw tooth 123 and the elastic claw arm 122 is in the horizontal plane of the inner and outer rings as much as possible, ensuring that the inner and outer swinging action of the claw 12 is stable and smooth.

In another embodiment, a lower part of the claw 12 is lower than an upper surface of the inner extension part 15. The claw 12 and the inner extension part 15 have a sufficiently high range of connection height, not only connecting with the upper surface of the inner extension part 15 ensures connection strength, but also when the lower end of the knob sidewall 21 corresponds to the inner extension part 15, the claw 12 has a height range in the upper and lower directions exceeding the height range at which the claw teeth 123 match with the knob teeth 23, which can ensure the strength and toughness of the claw 12.

In another embodiment, the lower part of the claw 12 is lower than the upper surface of the bearing part 151. The claw 12 and the inner extension part 15 have a sufficiently high range of connection height, not only connecting with the upper surface of the bearing part 151 ensures connection strength, but also when the lower end of the knob sidewall 21 corresponds to the bearing part 151, the claw 12 has a height range in the upper and lower directions exceeding the height range at which the claw teeth 123 match with the knob teeth 23, which can ensure the strength and toughness of the claw 12.

In another embodiment, a shaft cavity for accommodating the winding shaft 3 is formed in the barrel shell body 1 below the inner extension part 15. The winding shaft 3 is accommodated in the shaft cavity and is limited by the above inner extension part 15 to ensure stable and smooth rotation of the winding shaft 3. Further, lower surfaces of the elastic claw arm 122 and the limited block are higher than a lower surface of the inner extension part 15. There is a certain gap between the elastic claw arm 122 and the limited block, and the upper surface of the upper shaft wall of the winding shaft 3, to ensure that the elastic claw arm 122 and the limited block will not scratch the winding shaft 3 when they swing inward and outward, and the swinging is stable and smooth. Further, a lower surface of at least one of the elastic claw arm 122 and the limited block is provided with a claw protrusion 124. When necessary, such as when the claw 12 is subjected to downward pressure of the knob to be deformed downward and be close to the winding shaft 3, instead of the elastic claw arm 122 and the limited block, the claw protrusion 124 can contact the upper surface of the upper shaft wall of the winding shaft 3, to reduce the contact area and friction and ensure the stable and smooth swinging of the elastic claw arm 122 and the limited block.

In another embodiment, an upper surface of the inner extension part 15 is flush with an upper end of the barrel sidewall 11. This allows the upper surfaces of both the inner extension part 15 and the barrel sidewall 11 to support the knob, ensuring support strength, and in particular, no situation in which the knob extrudes and deforms the inner extension part 15 in a downward direction.

In another embodiment, a groove 132 for movement of the limited block is formed at a lower part of the limiting beam. When the limited block swings to the underside of the limiting beam, the groove 132 is used to accommodate the limited block to ensure the matching precision.

In another embodiment, the claw 12 and the barrel shell body 1 are integrally injection molded. This ensures the connection strength of components, reduces time consumed in assembly, and improves production efficiency.

In another embodiment, a molding through-hole for the claw 12 to be demolded and molded is formed between the claw 12 and the barrel sidewall 11. During processing, the claw 12 and the barrel sidewall 11 can be integrally injection molded by using the molding through-hole, which facilitates demolding and allows the elastic claw arm 122 to independently swing toward the inner and outer rings.

In another embodiment, the claw limiting part 13 and the barrel shell body 1 are integrally injection molded. This ensures the connection strength of components, reduces time consumed in assembly, and improves production efficiency.

In another embodiment, the claw tooth 123 comprises a first clamping surface 1232 facing a rope tightening direction, and a first back bevel 1233 facing a rope loosening direction; both the first clamping surface 1232 and the first back bevel 1233 are gradually inclined from root to tip toward the rope tightening direction. When the knob drives the winding shaft 3 to rotate in the rope tightening direction, the knob teeth 23 homeopathically match with the claw teeth 123 by relying on the first back bevel 1233, and after stopping, the claw teeth 123 and the knob teeth 23 are clamped and limited together by relying on the first clamping surface 1232, to prevent the knob and the winding shaft 3 from reversing.

In another embodiment, the knob tooth 23 comprises a second clamping surface 232 facing the rope loosening direction, and a second back bevel 233 facing the rope tightening direction; both the second clamping surface 232 and the second back bevel 233 are gradually inclined from root to tip toward the rope loosening direction. When the knob drives the winding shaft 3 to rotate in the rope tightening direction, the claw teeth 123 homeopathically match with the knob teeth 23 by relying on the second back bevel 233, and after stopping, the claw teeth 123 and the knob teeth 23 are clamped and limited together by relying on the second clamping surface 232, to prevent the knob and the winding shaft 3 from reversing.

In another embodiment, a plane is between the annular tooth wall 22 and the knob sidewall 21. This can match with the flush upper surfaces of the inner extension part 15 and the barrel sidewall 11 for even supporting, to ensure stable and smooth rotation of the knob.

A shoe, as shown in FIGS. 1-14, comprises a shoe body 5 and the anti-breaking claw rope retractor assembled to the shoe body 5. In the process of actual use, the anti-breaking claw rope retractor can be installed on the shoe, and specifically can be sewed or glued on the shoe body 5 through a connection base 4. The winding shaft 3 can rotate freely in the barrel shell, and under the driving of the knob, the winding shaft 3 can tighten the rope along the rope tightening direction. When the rope needs to be tightened, the knob is moved toward the direction of the barrel shell body 1, and the extruding bevel 231 at the lower end of the knob tooth 23 will extrude the claw 12 toward the direction of the inner ring, so that the limited part 121 of the claw 12 is clamped with the claw limiting part 13. The limiting position 131 of the claw limiting part 13 is matched with the limited part 121 of the claw 12 to limit the claw 12 along the axis of the winding shaft 3, so as to prevent the claw 12 from swinging upward, and the knob tooth 23 won't bring up the claw 12, so that the claw 12 won't bend upward, regardless of whether there is a tension of the rope or not, so as to ensure that the claw 12 will not be injured or even broken. The specific structure may be as follows: the limiting position 131 of the claw limiting part 13 prevents the knob teeth 23 from bringing up the end of the claw 12 where the claw teeth 123 are located by blocking above the limited part 121 of the claw 12. The extruding bevel 231 is specifically a bevel that is gradually inclined to the outer ring from top to bottom, and the extruding bevel 231 tends to extrude the claw teeth 123 toward the inner ring when the knob is moved downward. Further, the lower end of the extruding bevel 231 exceeds the lower end of the knob teeth 23 and forms a whole circle of bevel, and the extruding bevel 231 in the form of a whole circle of bevel may drive the claw teeth 123 toward the inner ring at any angle. The shoe body 5 may be a variety of footwear. Of course, the anti-breaking claw rope retractor of the present application can also be applied to other articles.

The product form of the present application is not limited to the drawings and embodiments herein, and appropriate variations or modifications thereof along similar lines by any person shall be deemed not to be out of the patent scope of the present application.

What is claimed is:

1. An anti-breaking claw rope retractor, comprising a barrel shell, a knob covering above the barrel shell, and a winding shaft inside the barrel shell; the barrel shell comprising a barrel shell body, the barrel shell body comprising a barrel sidewall and a claw disposed in an area above a lower end of the barrel sidewall; a direction toward the knob being above and an opposite direction being below; wherein the anti-breaking claw rope retractor further comprising a claw limiting part limiting swinging upward of the claw; the claw limiting part has a limiting position, and the claw has a limited part corresponding to the limiting position; the knob comprises a knob body; the knob body comprises a knob sidewall extending downward; the knob body comprises an annular tooth wall extending downward and corresponding to the claw, the annular tooth wall is disposed at an inner ring of the knob sidewall, a plurality of knob teeth facing the claw are formed on a side of an inner ring of the annular tooth wall, and a camming bevel surface is formed at a lower end of at least one of the annular tooth wall and the knob teeth, the camming bevel surface being configured to urge the claw to swing toward the inner ring such that the limited part of the claw engages with the claw limiting part.

2. The anti-breaking claw rope retractor according to claim 1, wherein the claw limiting part is connected to the barrel shell body; the claw limiting part is higher than the limited part, the claw limiting part and the limited part are axially offset.

3. The anti-breaking claw rope retractor according to claim 1, wherein the claw limiting part is above the limited part or at an inner ring of the limited part, the claw limiting part is disposed at the inner ring of the limited part, and the claw limiting part and the claw are axially offset; the knob body comprises a rotating drive part to drive the winding shaft to rotate, and the rotating drive part is disposed at the inner ring of the annular tooth wall; the claw limiting part is between a claw tooth and the rotating drive part, the winding shaft is provided with a rotating driven part that is matched with the rotating drive part.

4. The anti-breaking claw rope retractor according to claim 3, wherein the rotating drive part comprises a plurality of drive teeth arranged around an axis of the knob body, and the rotating driven part comprises a plurality of driven teeth arranged around the axis of the knob body and below the drive teeth, tips of the drive teeth face the driven teeth, and tips of the driven teeth face the drive teeth.

5. The anti-breaking claw rope retractor according to claim 4, wherein the rotating driven part extends upward into an inner ring of the claw limiting part, and the claw limiting part is between the claw tooth and the rotating driven part.

6. The anti-breaking claw rope retractor according to claim 4, wherein the knob body comprises a knob post facing the winding shaft, the knob post is disposed at an inner ring of the drive teeth, and the knob post and the knob body are coaxially disposed, the rotating driven part is between the claw limiting part and the knob post, a post protrusion is formed on a lower circumference of the knob post, the winding shaft has a shaft hole for the knob post to pass through, and the shaft hole and the knob post are coaxially disposed, the shaft hole is provided with an elastic clamping claw for matching with the post protrusion, and an arm protrusion facing the knob post and matching with the post protrusion is formed on an inner side of the elastic clamping claw, the elastic clamping claw extends up and down, a free end of the elastic clamping claw is disposed downward, the knob post comprises two elastic flaps having a flap gap therebetween, a flap protrusion is formed on a lower outer side of the elastic flap, and each of upper and lower parts of the flap protrusion has a flap bevel, a lower end of the elastic flap is provided with a flap extension part extending downward, the flap extension part being below the flap protrusion, the elastic flap is formed with a fine diameter part above the flap protrusion.

7. The anti-breaking claw rope retractor according to claim 4, wherein the drive tooth comprises a drive surface facing the rope tightening direction and a reverse bevel facing the rope loosening direction, and the drive surface is gradually inclined from root to tip toward the rope tightening direction; the driven tooth comprises a driven surface facing the rope loosening direction and a forward bevel facing the rope tightening direction, and the driven surface is gradually inclined from root to tip toward the rope loosening direction.

8. The anti-breaking claw rope retractor according to claim 1, wherein the claw comprises an elastic claw arm extending in a direction around the axis of the winding shaft and a claw tooth formed on the elastic claw arm and facing an outer ring, the elastic claw arm has an arm root and an arm end, and the claw tooth is disposed on an outer ring side of the arm end; the limited part is a limited block disposed on an inner ring side of the elastic claw arm, the limited block is disposed at a lower part of an inner ring side of the arm end, an upper part of the elastic claw arm is higher than the limited block, a space for the elastic claw arm to swing toward the inner ring is above the limited block.

9. The anti-breaking claw rope retractor according to claim 8, wherein an inner ring side of the limited block is flush with an outer ring side of the claw limiting part; or a plane perpendicular to the axis of the winding shaft is used as a projection plane, and a projection of the inner ring side of the limited block on the projection plane is disposed at an outer ring of a projection of the outer ring side of the claw limiting part on the projection plane, a distance between the projection of the inner ring side of the limited block on the projection plane and the projection of the outer ring side of the claw limiting part on the projection plane is smaller than a size of the knob to extrude the claw toward the inner ring, an upper end of the claw tooth is formed with a tooth homeopathic bevel or chamfer, a lower edge of the outer ring side of the claw limiting part or an upper edge of the inner ring side of the limited block is provided with a side homeopathic bevel or chamfer.

10. The anti-breaking claw rope retractor according to claim 8, wherein the elastic claw arm extends gradually from the arm root to the arm end in a direction away from the axis of the winding shaft.

11. The anti-breaking claw rope retractor according to claim 8, wherein a ring surface on which the elastic claw arm is located is disposed at an inner ring of a ring surface on which the barrel sidewall is located.

12. The anti-breaking claw rope retractor according to claim 8, wherein a projection of the elastic claw arm in the plane perpendicular to the axis of the winding shaft is disposed at the inner ring of a projection of the barrel sidewall in the plane perpendicular to the axis of the winding shaft, the barrel shell body has an inner extension part extending toward an inner ring, the elastic claw arm has an arm root and an arm end, and the inner extension part comprises a bearing part for bearing the claw, and the arm root is connected to the bearing part, the bearing part comprises a protruding part protruding upward, and the arm root is connected to the protruding part, the claw tooth is higher than an upper surface of the bearing part, upper parts of both the claw tooth and the elastic claw arm are higher than the inner extension part, a lower part of the claw is lower than an upper surface of the inner extension part, a lower part of the claw is lower than an upper surface of the bearing part, a shaft cavity for accommodating the winding shaft is formed in the barrel shell body below the inner extension part, lower surfaces of the elastic claw arm and the limited block are higher than a lower surface of the inner extension part, a lower surface of at least one of the elastic claw arm and the limited block is provided with a claw protrusion, an upper surface of the inner extension part is flush with an upper end of the barrel sidewall.

13. The anti-breaking claw rope retractor according to claim 12, wherein two or more claws and claw limiting parts are distributed around the axis of the winding shaft, the claw limiting part is a limiting beam corresponding to the claw one by one, the limiting beam is connected between adjacent arm roots, each limiting beam forms a whole circle and the inner ring forms a through-opening extending in an axila direction, the knob body comprises a knob post facing the winding shaft, and the knob post passes downward through the through-opening, the winding shaft is provided with a rotating driven part that passes upward through the through-opening and matches with the rotating drive part, a gap for the elastic claw arm to swing toward the inner ring is disposed between the limiting beam and the elastic claw arm, a tooth height from a root to a tip of the claw tooth is smaller than a size of the gap between the limiting beam and the elastic claw arm, a groove for movement of the limited block is formed at a lower part of the limiting beam.

14. The anti-breaking claw rope retractor according to claim 13, wherein the claw is between the limiting beam and the barrel sidewall, and an elastic swinging space for the elastic claw arm to swing inward and outward is formed between the limiting beam and the barrel sidewall.

15. The anti-breaking claw rope retractor according to claim 12, wherein a clearance gap is between the elastic claw arm and the barrel sidewall, a clearance gap is between the elastic claw arm and the claw limiting part, and a clearance gap is between the elastic claw arm and the bearing part, the clearance gap runs up and down extending in an axila direction.

16. The anti-breaking claw rope retractor according to claim 12, wherein two or more claws and claw limiting parts are distributed around the axis of the winding shaft; two or more protruding parts are connected to the arm root one by one, and a limiting beam is connected between adjacent protruding parts.

17. The anti-breaking claw rope retractor according to one of claim 1, wherein the claw tooth comprises a first clamping surface facing a rope tightening direction, and a first back bevel facing a rope loosening direction; both the first clamping surface and the first back bevel are gradually inclined from root to tip toward the rope tightening direction, the knob tooth comprises a second clamping surface facing the rope loosening direction, and a second back bevel facing the rope tightening direction; both the second clamping surface and the second back bevel are gradually inclined from root to tip toward the rope loosening direction, a plane is between the annular tooth wall and the knob sidewall.

18. A shoe using the anti-breaking claw rope retractor according to claim 1, comprising a shoe body and the anti-breaking claw rope retractor assembled to the shoe body.

* * * * *